US008627748B2

(12) United States Patent
Gouws

(10) Patent No.: US 8,627,748 B2
(45) **Date of Patent: *Jan. 14, 2014**

(54) WRENCH FOR USE WITH A DRILLING APPARATUS

(76) Inventor: Petrus Christiaan Gouws, Witbank (ZA)

( * ) Notice: Subject to any disclaimer, the term of this patent is extended or adjusted under 35 U.S.C. 154(b) by 314 days.

This patent is subject to a terminal disclaimer.

(21) Appl. No.: 12/739,291

(22) PCT Filed: Oct. 17, 2008

(86) PCT No.: PCT/IB2008/054268

§ 371 (c)(1),
(2), (4) Date: Apr. 22, 2010

(87) PCT Pub. No.: WO2008/126543

PCT Pub. Date: Oct. 23, 2008

(65) Prior Publication Data

US 2011/0138969 A1 Jun. 16, 2011

(30) Foreign Application Priority Data

Oct. 23, 2007 (ZA) ..... 2007/09144

(51) Int. Cl.
*B25B 17/00* (2006.01)
*B25B 13/50* (2006.01)

(52) U.S. Cl.
USPC ..... 81/57.19; 81/57.16; 81/57.33

(58) Field of Classification Search
USPC ..... 81/57.33, 57.34, 57.3, 57.16, 57.19
See application file for complete search history.

(56) References Cited

U.S. PATENT DOCUMENTS

| | | | | |
|---|---|---|---|---|
| 2,760,392 | A | 8/1956 | Paget | |
| 4,194,419 | A * | 3/1980 | Mitchhart et al. | 81/57.33 |
| 5,653,297 | A | 8/1997 | Whisenhunt | |
| 5,791,206 | A | 8/1998 | Daigle et al. | |
| 5,996,444 | A * | 12/1999 | Pearce et al. | 81/57.19 |
| 6,012,360 | A | 1/2000 | Concha | |
| 6,817,271 | B2 * | 11/2004 | Gouws | 81/57.33 |
| 8,453,542 | B2 * | 6/2013 | Gouws | 81/57.2 |
| 2003/0131689 | A1 | 7/2003 | Gouws | |
| 2011/0146457 | A1 * | 6/2011 | Gouws | 81/57.34 |

FOREIGN PATENT DOCUMENTS

WO 99/22915 5/1999

OTHER PUBLICATIONS

International Search Report for PCT/IB2008/054268 Dated Jul. 15, 2009.

* cited by examiner

*Primary Examiner* — Monica Carter
*Assistant Examiner* — Danny Hong
(74) *Attorney, Agent, or Firm* — Nixon Peabody LLP; Jeffrey L. Costellia

(57) ABSTRACT

The invention relates to a drill bit wrench (10) for use on a drilling apparatus for loosening a drill bit segment of a drill bit during drilling of holes into the ground. The wrench includes a carrier member (12) operatively supported on the drilling apparatus. A gripping member (26) is displaceably located on the carrier member and a lever arm (38) is pivotally located on the gripping member, displacement mechanisms (20, 34, 42) providing for required displacement of the parts of the wrench for its operation. One displacement mechanism (42) provides for an initial direct gripping force to be applied on a drill bit segment, which force is sufficient to permit loosening of the segment in normal circumstances, an additional gripping force, to be induced by a wedging action of a wedge face of the lever arm, being provided for, where required.

7 Claims, 18 Drawing Sheets

WRENCH FOR USE WITH A DRILLING APPARATUS

FIELD OF INVENTION

This invention relates to a wrench for use with drilling apparatus.

The invention relates particularly to a wrench for use with drilling apparatus used for drilling holes into the ground with a drill rod comprising a drilling segment, extension segments and a distance piece, the distance piece, in use, being engaged by the drilling apparatus, thereby to connect the drill rod to the drilling apparatus. The above segments of a drill rod are hereinafter referred to merely as drill rod segments.

BACKGROUND TO INVENTION

As part of a drilling operation, extension segments of a drill rod must be located in line with or removed from a drill rod, which requires adjacent segments of a drill rod, connected via complementary threads in a spigot and socket fashion, to be loosened with respect to one another. Insofar as the thread configuration of drill rod segments of a drill rod provide for segments to be tightened together during drilling, a wrench, referred to herein as a drill rod wrench, that is operatively mounted on the support structure of a drilling apparatus, is provided for loosening adjacent segments, many different configuration drill rod wrenches being already well known which each provide essentially for a drill rod segment to be gripped between opposing jaws and for the wrench to be displaced around the drill rod gripped, for loosening thereof.

A particular drill rod wrench that forms the subject matter of the Applicant's U.S. Pat. No. 6,817,271 comprises a gripping arm, that defines a mouth formation locatable around a drill rod segment and that has gripping formations located thereon, and a lever arm, that defines a wedge face and that is pivotally connected to the gripping arm, particularly in a configuration in which initial pivotal displacement of the lever arm with respect to the gripping arm provides for the wedge face defined thereby to act on the drill rod segment to be gripped for urging the drill segment into gripping engagement with oppositely located gripping formations of the gripping arm. Continued displacement of the lever arm then provides for loosening of the drill segment relative to an adjacent segment, the force applied by the wedge face on the drill rod for urging it into gripping engagement with the gripping formations, due to its relative displacement with respect to the drill rod segment, increasing until loosening of the drill rod segment occurs. The displacement of the lever arm is induced by a piston/cylinder mechanism acting between the lever arm and the support structure of the drilling apparatus, the exact configuration of the wrench being clearly apparent from the disclosure of the Applicant's abovementioned patent.

It has become apparent that the drill rod wrench forming the subject matter of the Applicant's abovementioned patent is very effective in relation to the required loosening of adjacent drill rod segments, but insofar as the general configuration of different drilling apparatus requires a wrench to operate within different space parameters, the wrench as originally envisaged and as covered in the above patent cannot be employed in association with all drilling apparatus. As such, it is an object of this invention to provide an alternative configuration drill rod wrench which can operate in a relatively more restricted space, while still utilizing the gripping arrangement, including a gripping arm and a lever arm as above envisaged, for gripping a drill rod segment.

SUMMARY OF INVENTION

According to the invention there is provided a drill rod wrench for use on a drilling apparatus for loosening a drill rod segment of a drill rod, having a diameter falling within a predetermined diameter range, with respect to an adjacent drill rod segment of the drill rod, which includes, in its operative configuration with respect to a drilling apparatus having a support structure supporting the apparatus in a location where drilling is required, a carrier member that is pivotally supported on the support structure of the drilling apparatus in a configuration in which the wrench is displaceable between an inoperative stowed-away configuration when drilling is permitted and an operative configuration in which the wrench is operable for loosening a drill rod segment;

a gripping member that defines an open mouth formation within which a drill rod segment to be gripped for loosening is positionable, the gripping member being displaceably located on the carrier member for rotational displacement about the axis of a drill rod segment operatively positioned within the mouth formation of the gripping member;

a lever arm pivotally located on the gripping member for pivotal displacement about a pivot axis, the lever arm defining a convex wedge face that, by pivotal displacement of the lever arm with respect to the gripping member and with a drill rod segment operatively positioned within the mouth formation of the gripping member, acts on the drill rod segment for urging the drill rod segment into gripping engagement with oppositely located gripping elements located in the mouth formation of the gripping member and that, by rotational displacement of the gripping member about the axis of the drill rod segment gripped, performs a wedging action on the drill rod segment until the drill rod segment loosens due to such rotation, for further urging the drill rod segment into gripping engagement with the gripping elements of the gripping member; and displacement mechanisms for displacing, respectively, the carrier member between its inoperative configuration and its operative configuration, the lever arm about its pivot axis and the gripping member with respect to the carrier member about an axis defined by a drill rod segment positioned within the mouth of the gripping member.

The drill rod wrench of the invention may include a mounting structure on which the carrier member is pivotally located, the mounting structure being configured for mounting the wrench on the support structure of the drilling apparatus with which the wrench is to be associated and thereby to provide for the required pivotal support of the carrier member with respect to the support structure. The configuration of the mounting structure may be determined particularly by the configuration of the support structure of a drilling apparatus on which it is to be mounted.

The carrier member of the drill rod wrench may be a plate-like member that is pivotally located on the mounting structure and the displacement mechanism for displacing the carrier member between its inoperative configuration and its operative configuration may be a first hydraulically operable piston/cylinder mechanism that is operatively connected between the mounting structure and the carrier member in a configuration in which operation of the mechanism provides for the required displacement of the carrier member between its inoperative and operative configurations.

The gripping member of the drill rod wrench of the invention also may comprise a plate-like member, the gripping member, for its location with respect to the carrier member defining a pair of arcuate slots within which locating pins projecting from the carrier member are locatable to provide for the location of the gripping member with respect to the carrier member in the required configuration in which the gripping member is rotationally displaceable about the axis of a drill rod segment operatively located within the mouth formation defined thereby, in use of the drill rod wrench.

The open end of the open mouth formation defined by the gripping member of the drill rod wrench may be defined by two spaced apart end formations of the gripping member, the pivot axis determining the pivotal location of the lever arm on the gripping member being located near one end formation in a location where, through pivotal displacement of the lever arm with respect to the gripping member, the convex wedge face will effectively push a drill rod segment located within the open mouth formation towards and into gripping engagement with the gripping elements located in the open mouth formation of the gripping member, particularly in substantially diametrically opposite locations with respect to the drill rod segment to the location where the convex wedge face acts on the drill rod segment when pivotally displaced with respect to the gripping member. The exact contact point of the convex wedge face with a drill rod segment resulting from the pivotal displacement of the lever arm with respect to the gripping member, particularly is such that in response to rotational displacement of the gripping member about the axis of the drill rod segment gripped, the convex wedge face can perform a wedging action on the drill rod segment for further urging the drill rod segment into gripping engagement with the gripping elements of the gripping member, particularly providing for enhanced gripping engagement until the drill rod segment loosens with respect to an adjacent segment as required.

The displacement mechanism for displacing the lever arm about its pivot axis may be a second hydraulically operable piston/cylinder mechanism connected for operation between the gripping member and the lever arm, this second piston/cylinder mechanism having an operating capacity for urging the convex wedge face of the lever arm against a drill rod segment positioned in the open mouth formation of the gripping member with a sufficient force to induce gripping engagement with the gripping elements of the gripping member to permit loosening of the drill rod segment gripped in ordinary circumstances.

The displacement mechanism for displacing the carrier member about an axis defined by a drill rod segment positioned within the mouth of the gripping member may be a third hydraulically operable piston/cylinder mechanism, particularly connected for operation between the carrier member and the gripping member, the point of attachment to the gripping member coinciding with the point of attachment of the second piston/cylinder mechanism with the gripping member. The capacity of the third piston/cylinder mechanism particularly is such that a sufficient rotational force can be applied to a drill rod segment gripped within the open mouth formation defined by the gripping member for loosening thereof, the relationship between the second and third piston/cylinder mechanisms being such that where the hydraulic pressure applied by the third piston/cylinder mechanism for loosening a drill rod segment is to exceed the pressure applied by the second piston/cylinder mechanism, the increased pressure is effectively imparted also on the second piston/cylinder mechanism, particularly due to the wedging action on the drill rod segment that enhances the gripping engagement of the drill rod segment by the gripping elements of the gripping member.

It must be understood that the exact configuration of the drill rod wrench of the invention is greatly variable and particularly also that the operation of the wrench can be adapted to accommodate different support locations of the wrench on the support structure of an associated drilling apparatus in order to provide for the rotational force to act on a drill rod segment to be loosened to be imparted in a required rotational direction for loosening. Also, the exact mechanical construction of the drill rod wrench as above defined is greatly variable, the construction particularly being such that the wrench can operate within predetermined space restrictions, as determined by the construction of the drilling apparatus with which the wrench is to be used.

BRIEF DESCRIPTION OF THE DRAWINGS

The above and further features of the drill rod wrench of the invention are described hereafter with reference to two examples of drill rod wrenches that are illustrated in the accompanying diagrammatic drawings. In the drawings.

DESCRIPTION OF THE PREFERRED EMBODIMENTS

Figure 1:
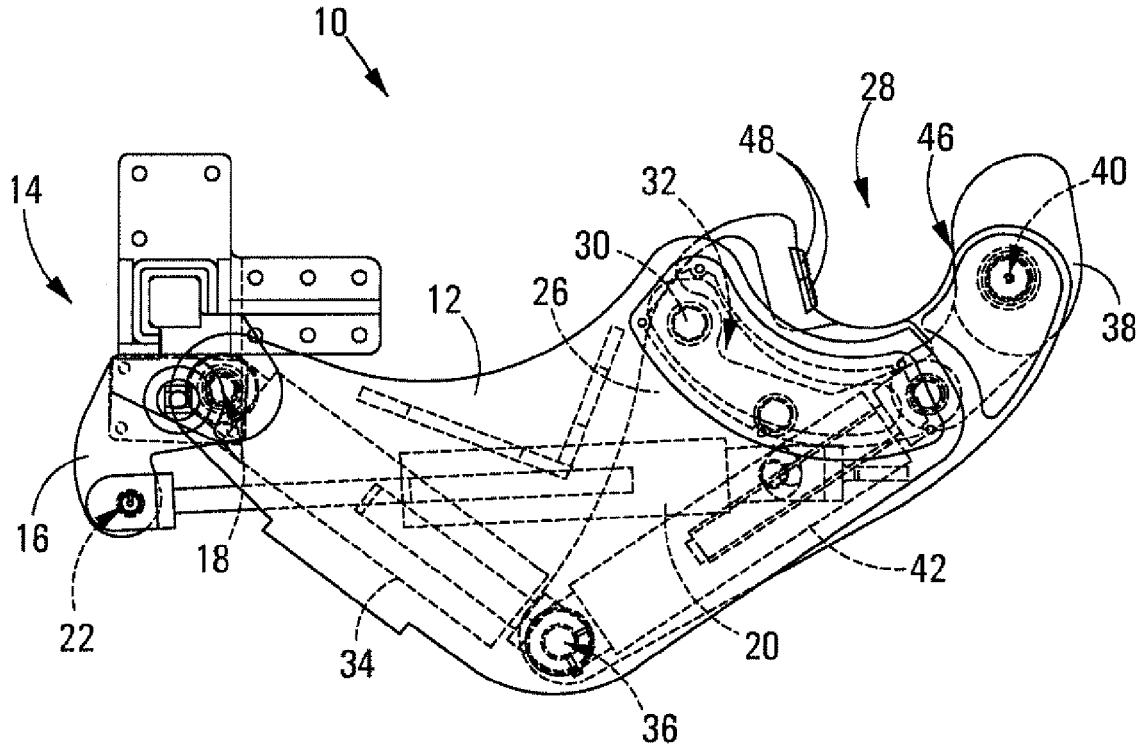
FIGS. 1 to 6 show various views of a first embodiment of a drill rod wrench for use with drilling apparatus, in accordance with the invention.

Referring initially to FIGS. 1 to 8 of the drawings, a first embodiment of a drill rod wrench for use with drilling apparatus, in accordance with the invention, is designated generally by the reference numeral 10. The drill rod wrench 10 includes a carrier member 12 that, in the operative configuration of the drill rod wrench with respect to a drilling apparatus, is pivotally mounted on the support structure 14 of the drilling apparatus, typically via a mounting structure including a mounting bracket 16, which may form a part of the drill rod wrench. The support structure of the drilling apparatus clearly is only partially shown. The carrier member is pivotally displaceable about a pivot axis 18 by the operation of a first hydraulically operable piston/cylinder mechanism 20, the mechanism 20 being operable between a location 22 on the bracket 16 and a location 24 on the carrier member 12, as shown. The pivotal displacement of the carrier member 12 with respect to the support structure 14 by the operation of the piston/cylinder mechanism 20 is described and explained in more detail hereafter.

The drill rod wrench 10 includes also a gripping member 26 that defines an open mouth formation 28 within which a drill rod segment of a drill rod of a drilling apparatus is receivable by the operation of the drill rod wrench, the gripping member 26 being located for rotational displacement about the axis of a drill rod segment received within the open mouth formation 28, particularly by the location of two locating pins 30 within arcuate slots 32 defined in the carrier member 12. As such, by rotational displacement as envisaged, a drill rod segment gripped within the mouth formation 28 can be effectively loosened with respect to an adjacent segment. Rotational displacement of the gripping member 26 can be effected by the operation of a second hydraulically operable piston/cylinder mechanism 34 that is operatively connected between the location of the pivot axis 18 on the carrier member 12 and the location 36 on the gripping member 26, as is illustrated clearly in FIG. 8 of the drawings.

The drill rod wrench 10 includes also a lever arm 38 that is pivotally located on the gripping member 26 via a pivot pin defining a pivot axis 40, the lever arm 38 being pivotally displaceable about the pivot axis 40 by the operation of a third hydraulically operable piston/cylinder mechanism 42, which is connected between the location 36 on the gripping member 26 and the free end 44 of the lever arm 38.

The lever arm 38 defines a convex wedge formation 46 that, by pivotal displacement of the lever arm with respect to the gripping member and with a drill rod segment operatively received within the mouth formation 28, acts directly on the drill rod segment for urging the drill rod segment into gripping engagement with oppositely located gripping elements 48, that are located on the gripping member 26 within the mouth formation 28, as is illustrated and explained in more detail hereafter. By the operation of the drill rod wrench 10 as described hereafter, the pivotal displacement of the lever arm 38 with respect to the gripping member 26 will provide for effective gripping of a drill rod segment within the mouth formation 28 of the gripping member 26 and hence by rotational displacement of the gripping member 26 about the axis of the drill rod segment so gripped, loosening of the drill rod segment with respect to an adjacent segment is provided for. Where the initial gripping force on a drill rod segment for loosening is insufficient, the rotational force on the gripping member will induce the lever arm 38, by a wedging action, to act on the drill rod segment to further enhance the gripping force, particularly until loosening occurs. This is explained further hereafter.

It will be appreciated that the construction of the drill rod wrench 10 is not illustrated in detail, although this construction in relation to the operation of the drill rod wrench will be apparent to those skilled in the art. It will also be appreciated that the exact construction of the drill rod wrench is greatly variable, while it can still permit loosening of one drill rod segment with respect to an adjacent segment, as is required of a drill rod wrench as herein envisaged.

Referring now also to FIGS. 9 to 15 of the drawings, the operation of the drill rod wrench 10 is illustrated, particularly as part of a drilling operation whereby the associated drilling apparatus is used for drilling a hole into the ground by means of a drill rod, including a plurality of drill rod segments that are connected in line with one another by means of complementary threads in a spigot and socket fashion. During drilling of a hole, drill rod segments need to be connected in line with the drill rod, requiring existing adjacent drill rod segments to be loosened with respect to one another. Such loosening permits separation of these segments and the insertion of an additional segment, which permits an additional depth of hole to be drilled. During the removal of a drill rod from a hole drilled, adjacent drill rod segments again must be loosened with respect to one another, in this case to permit the removal of drill rod segments, the drilling operation and the use of a drill rod wrench in this regard already being well known and not being described in further detail herein.

Figure 2:
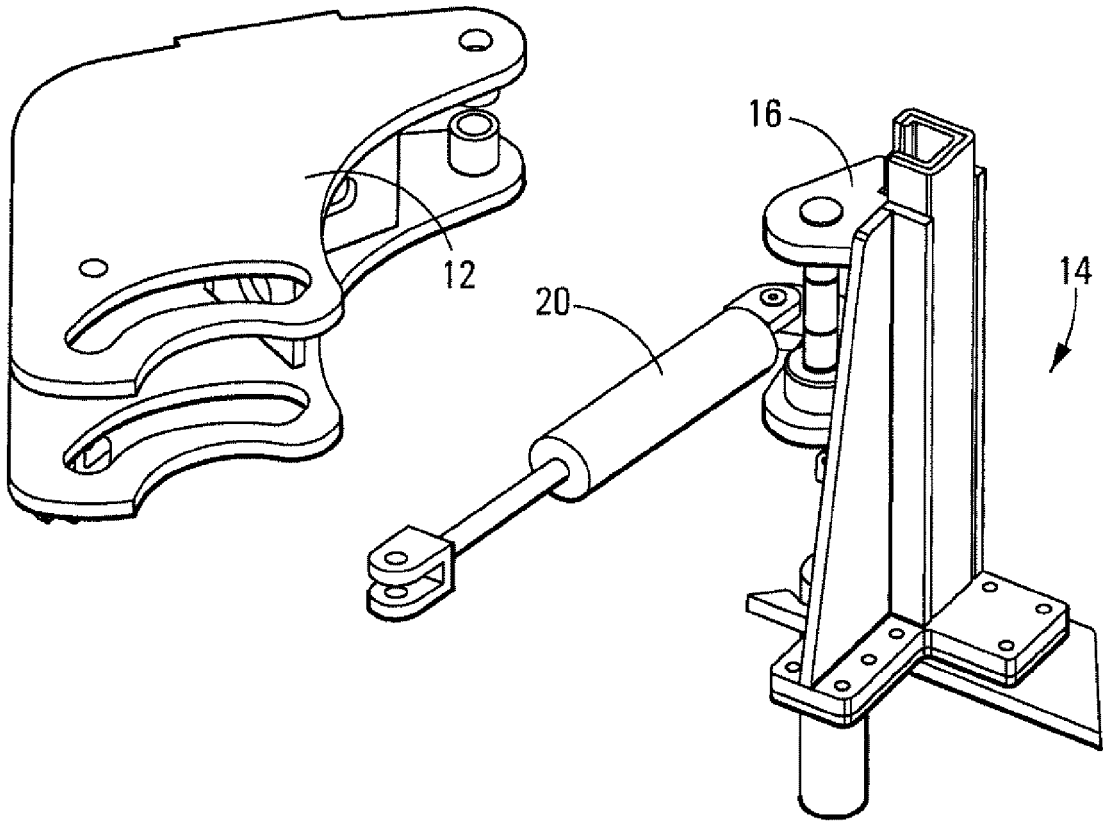
Figure 3:
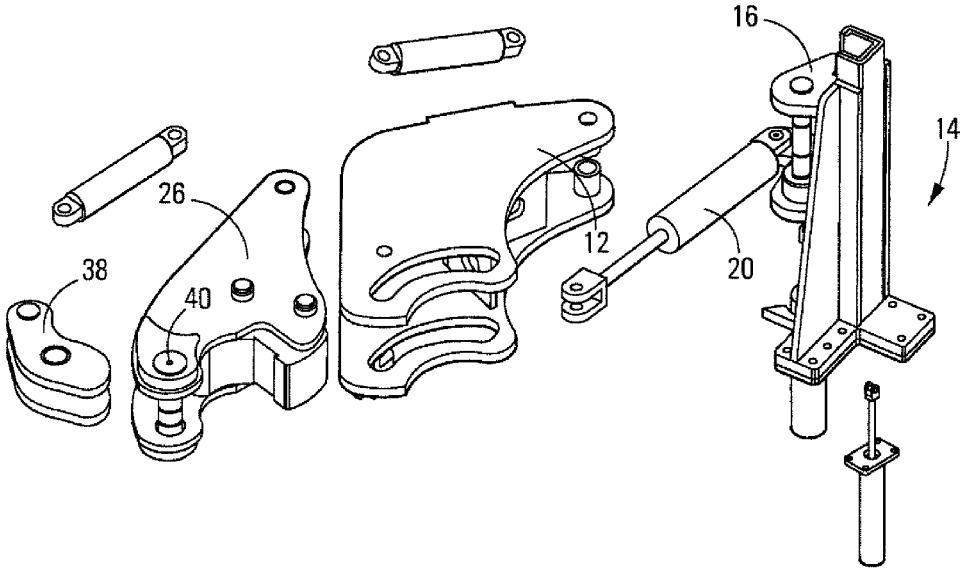
Figure 4:
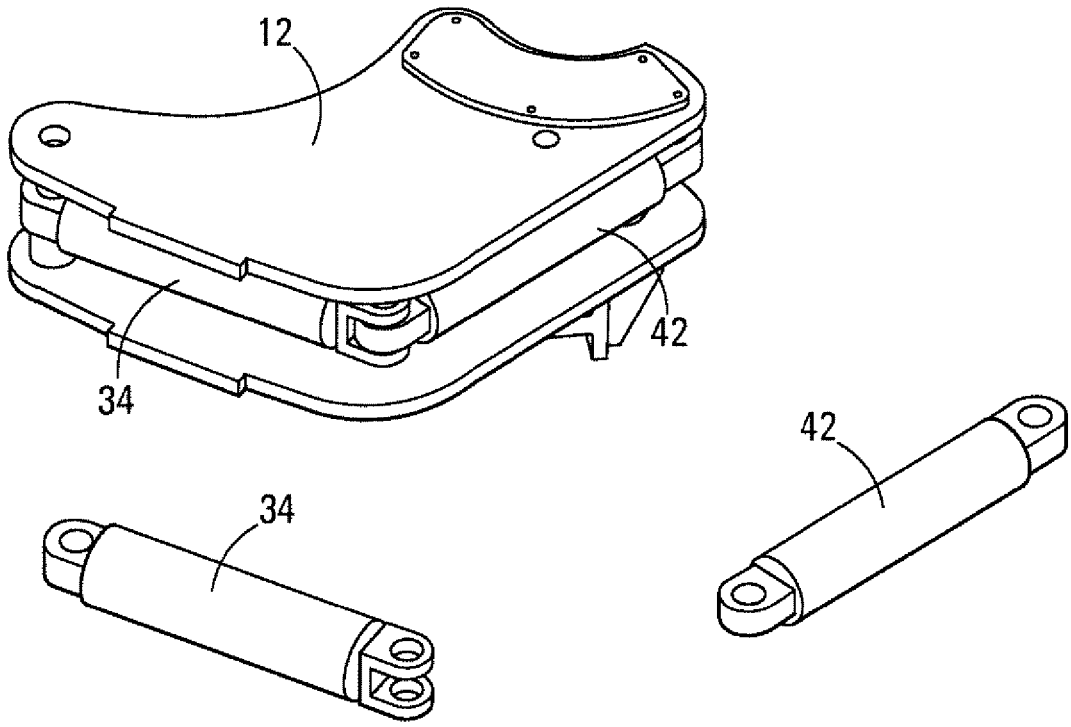
Figure 5:
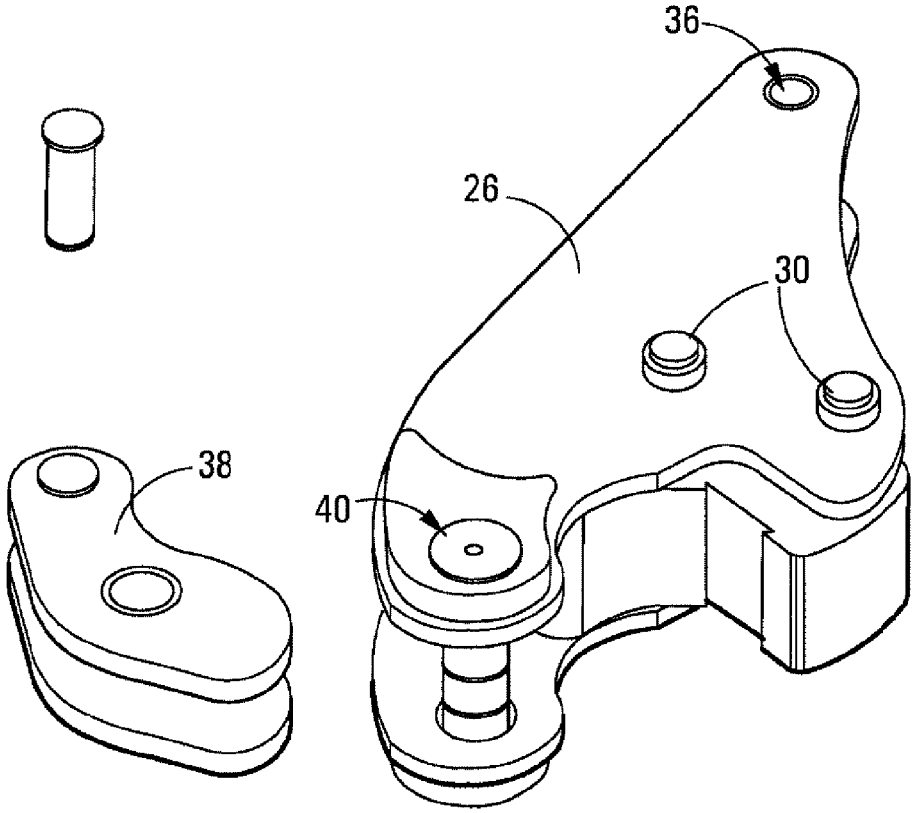
Figure 6:
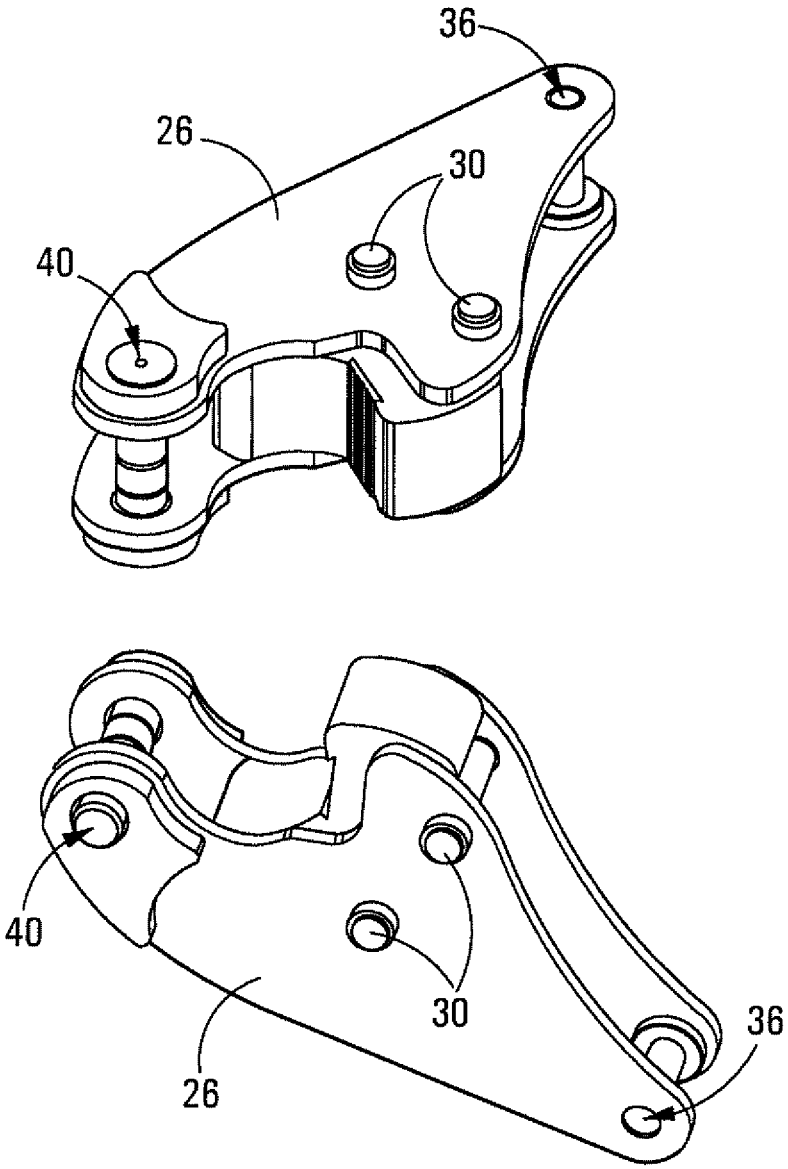
Figure 7:
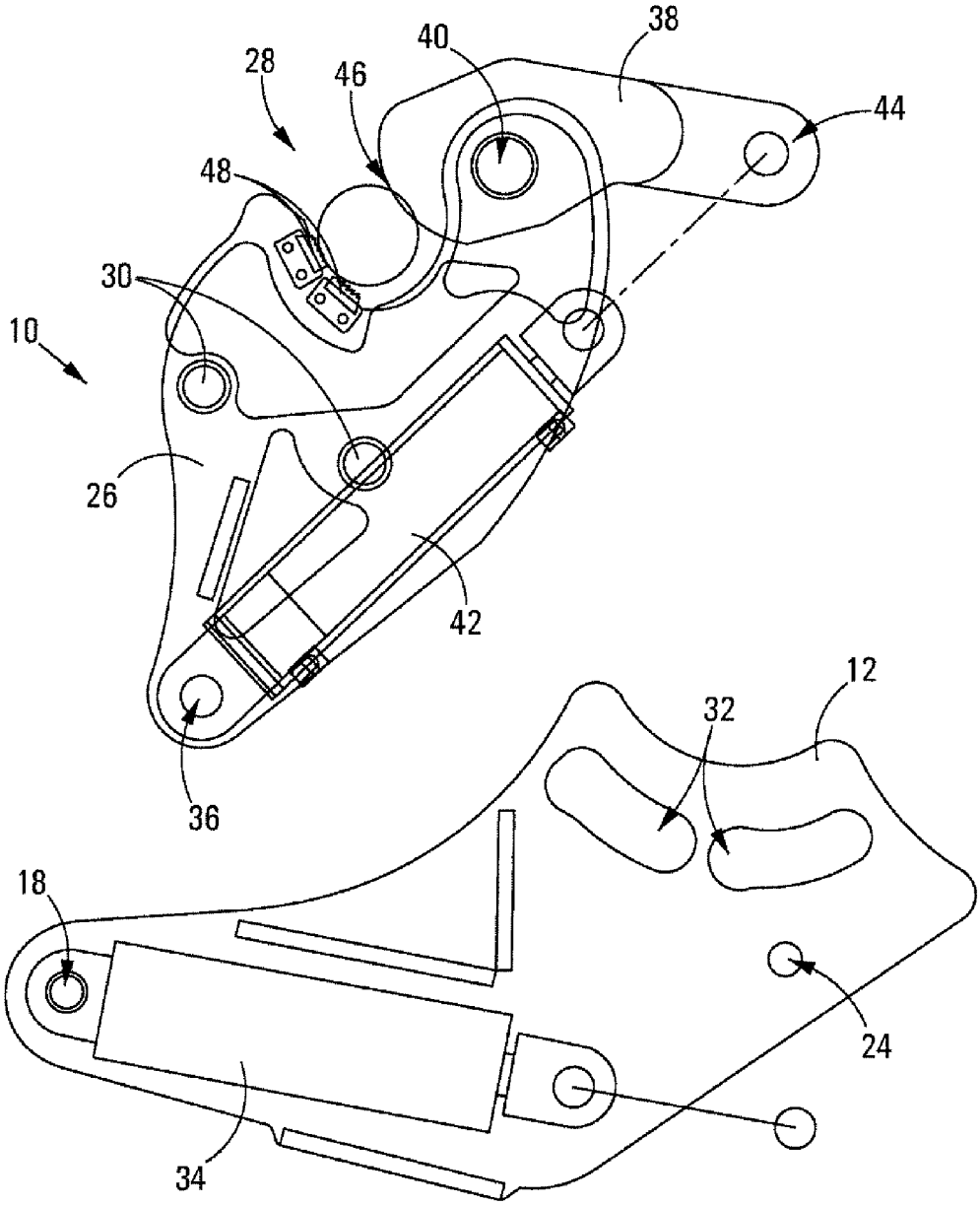
FIG. 7 shows an exploded plan view of the first embodiment of the drill rod wrench, in accordance with the invention.
Figure 8:
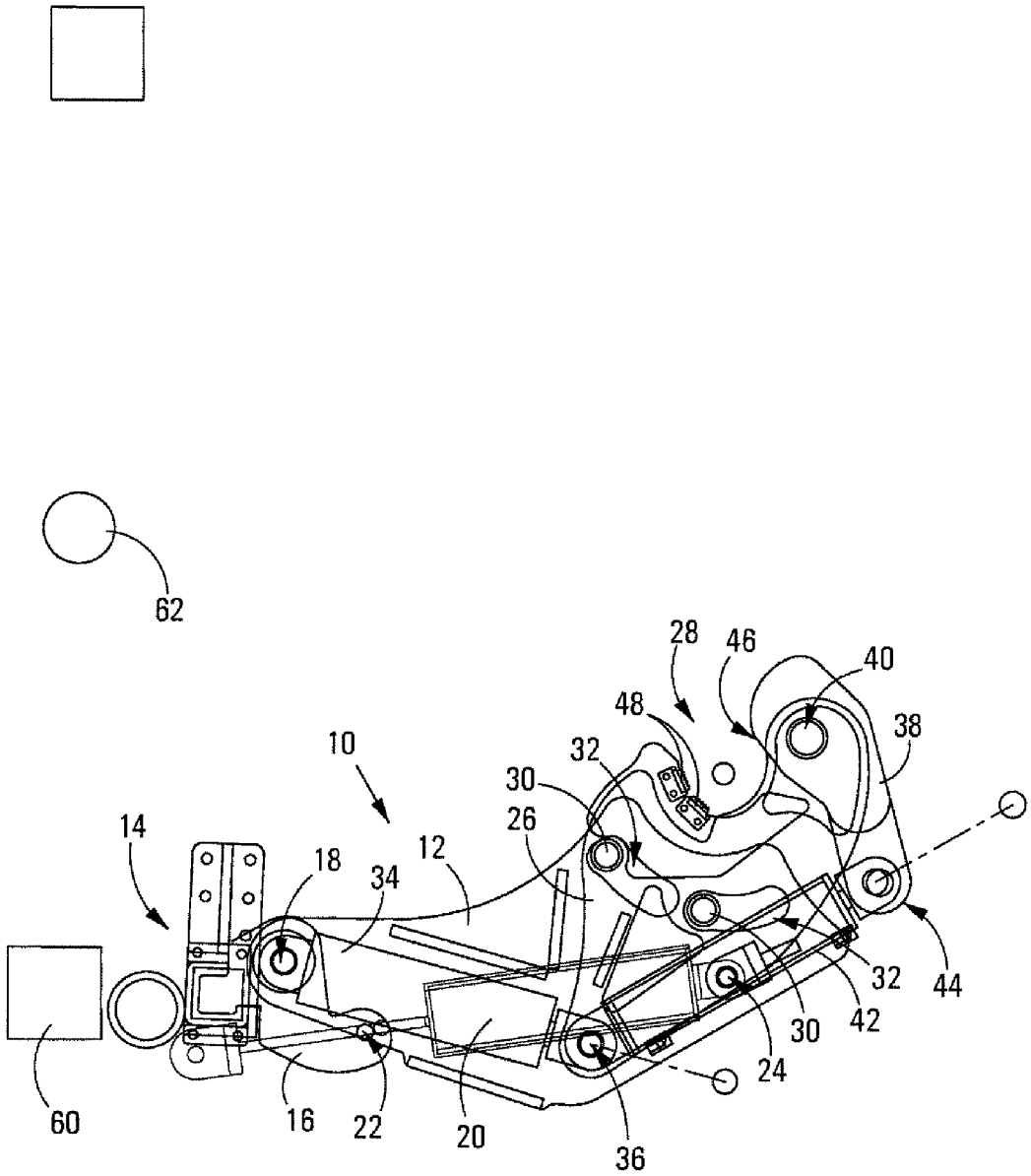
FIG. 8 shows in plan view the drill rod wrench of FIG. 7 in its assembled configuration and mounted on the support structure of a drilling apparatus.
Figure 9:
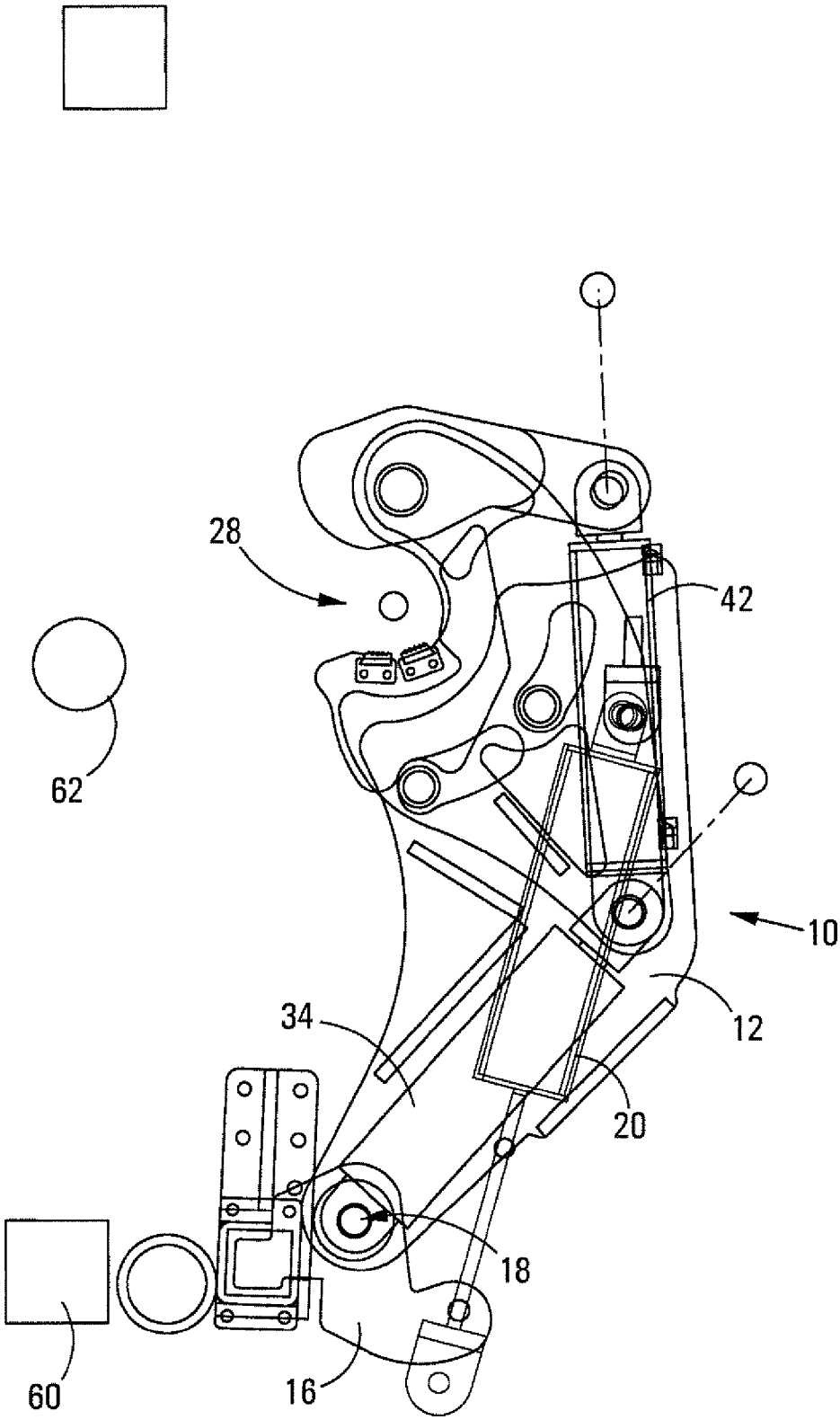
FIGS. 9 to 15 illustrate in plan view the operation of the drill rod wrench as shown in FIG. 2.
Figure 10:
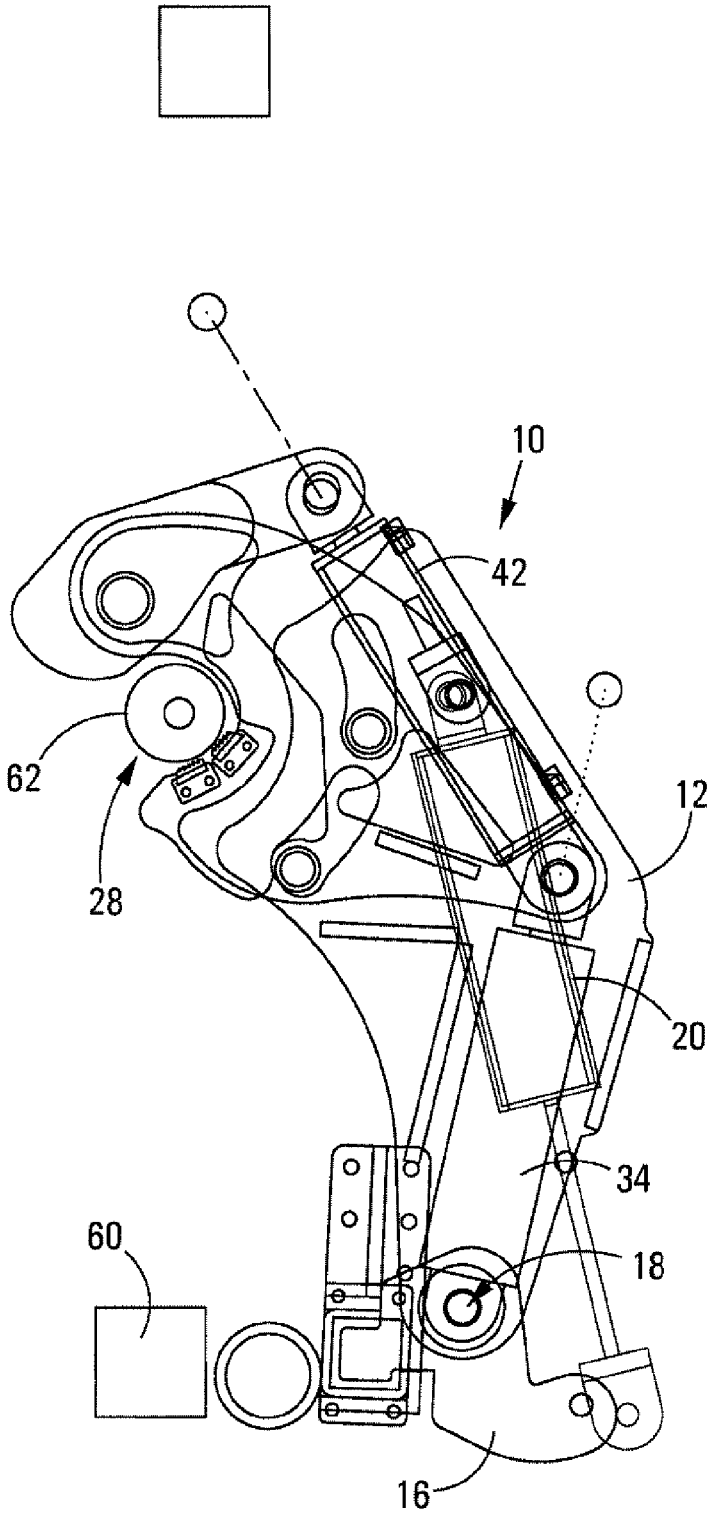

FIGS. 8 to 15 illustrate a part of the support structure of a drilling apparatus, with the drill rod wrench 10 mounted on a support post 60 of the support structure, the location of a drill rod segment 62 of a drill rod whereby a hole is drilled into the ground, with respect to the support structure, being clearly illustrated. When the drill rod segment is to be loosened with respect to an adjacent segment, the drill rod wrench 10 is pivotally displaced from its inoperative, stowed away, configuration as shown in FIG. 2, via the configuration as shown in FIG. 9, into an operative configuration as shown in FIG. 4, the drill rod segment 62, in this configuration, being freely located within the mouth formation 28 that is defined by the gripping member 26 of the drill rod wrench. The displacement of the drill rod wrench 10 from its position as shown in FIG. 8 to its position as shown in FIG. 10 particularly is effected by the operation of the piston/cylinder mechanism 20, which serves to pivotally displace the carrier member 12 about the pivot axis 18.

Figure 11:
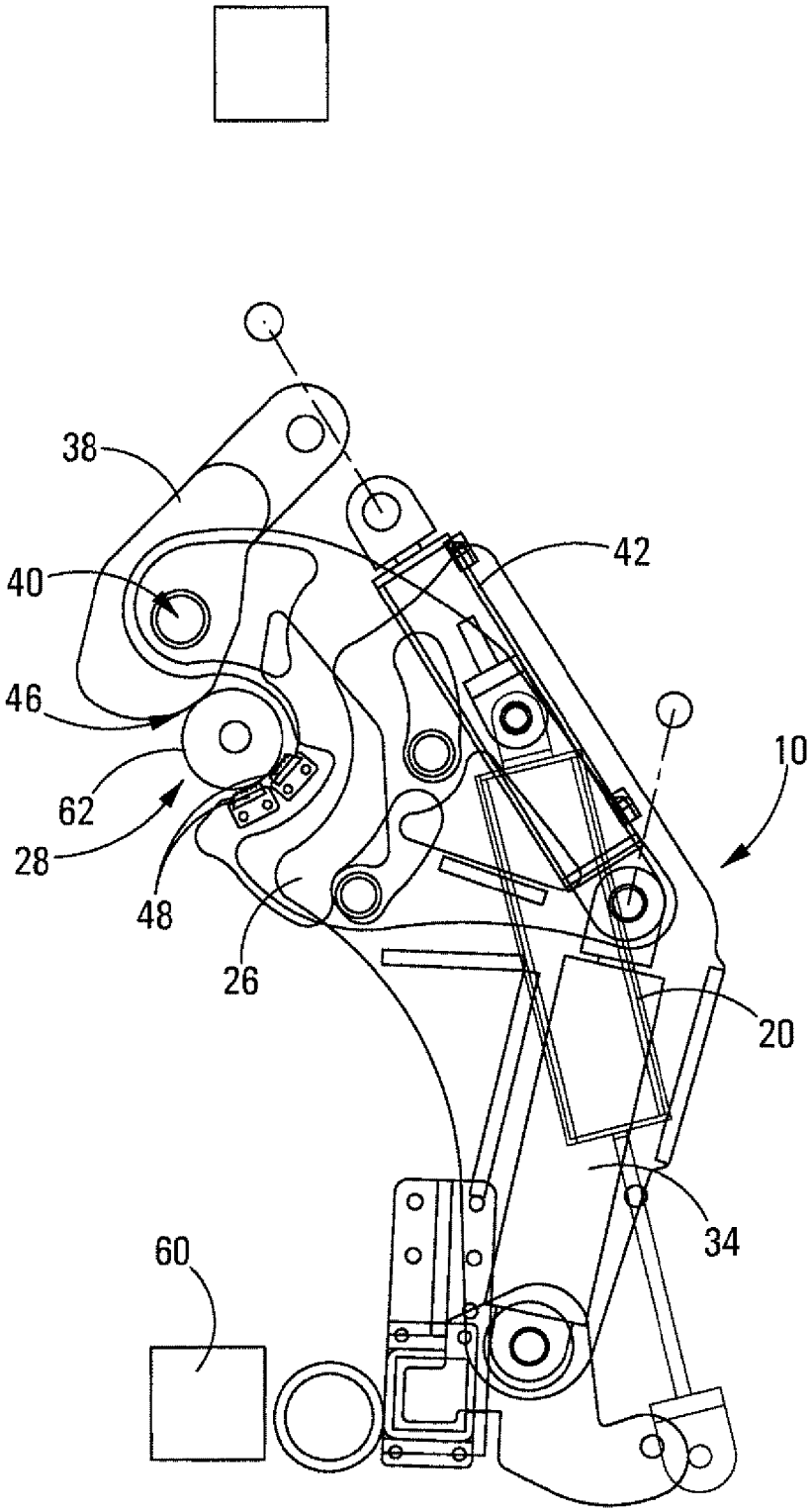
Figure 12:
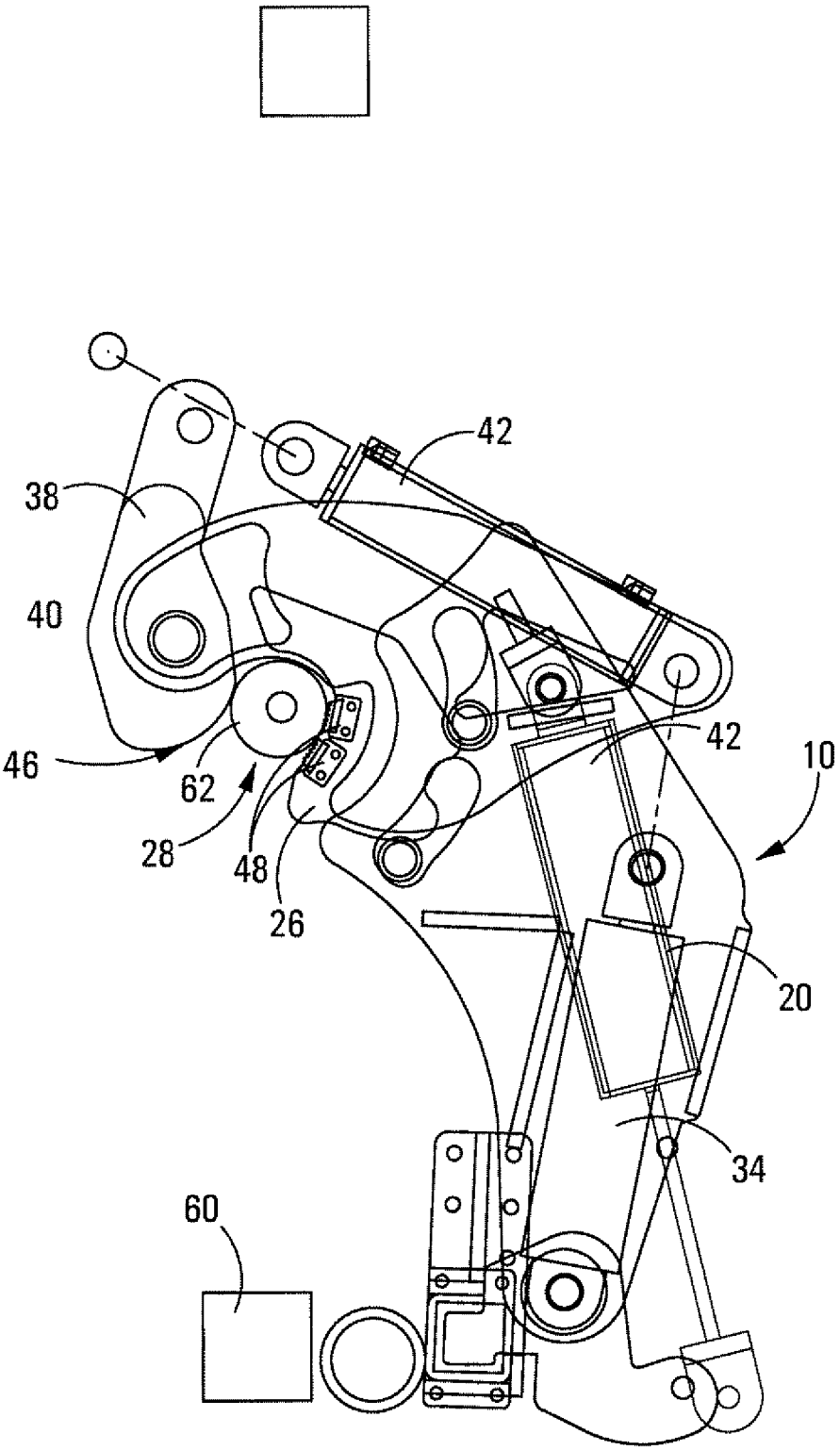

Following the displacement of the drill rod wrench 10 into its position as shown in FIG. 10, by the operation of the piston/cylinder mechanism 42, the lever arm 38 is pivotally displaced about its pivot axis 40, thereby providing for the drill rod segment 62 to be urged directly into gripping engagement with the gripping elements 48. The force applied by the piston/cylinder mechanism 42 on the lever arm 38 particularly is such that the gripping force on the drill rod segment 62 ordinarily is such that it is sufficient to permit loosening of the drill rod segment by rotational displacement of the gripping member being performed with an equal or a lesser force being applied by the piston/cylinder mechanism 34. The rotational displacement of the gripping member 26 by the operation of the piston/mechanism 34 from a position as shown in FIG. 11 to a position as shown in FIG. 12 is clearly illustrated.

In a situation in which loosening of the drill rod segment 62 is still resisted when the force applied by the piston/cylinder mechanism 34 equals the force applied by the piston/cylinder mechanism 42, this force can be increased and will in turn be transmitted to the piston/cylinder mechanism 42, particularly by inducing displacement of the lever arm 38 with respect to the drilling segment and the gripping force on the segment 62, due to the resulting wedging action on the segment, being simultaneously increased, at least until loosening of the segment occurs. This will ensure the effective operation of the drill rod wrench even in the situation in which "exceptional" rotational forces on the drill rod segment are required for loosening thereof.

Figure 13:
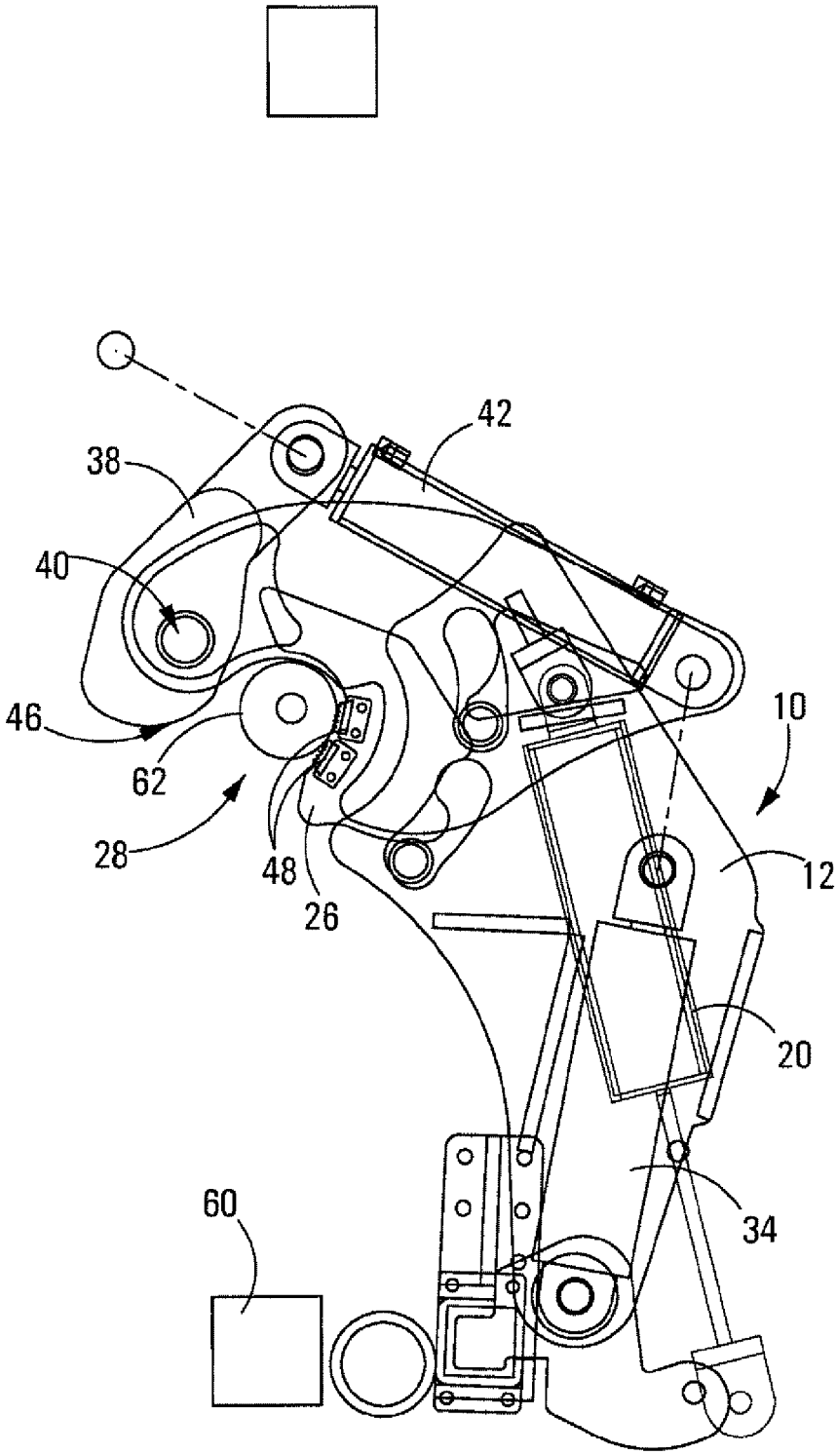
Figure 14:
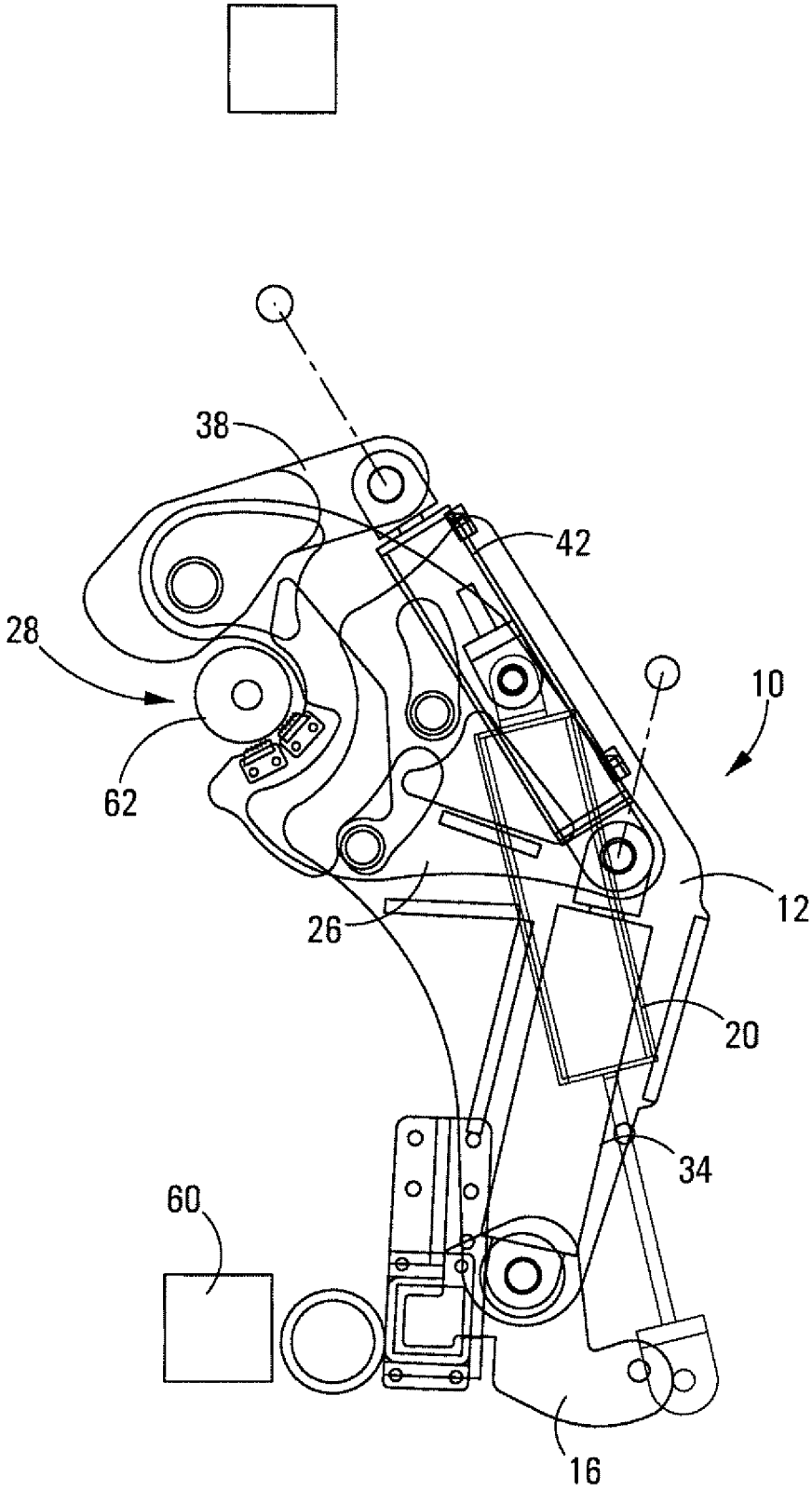
Figure 15:
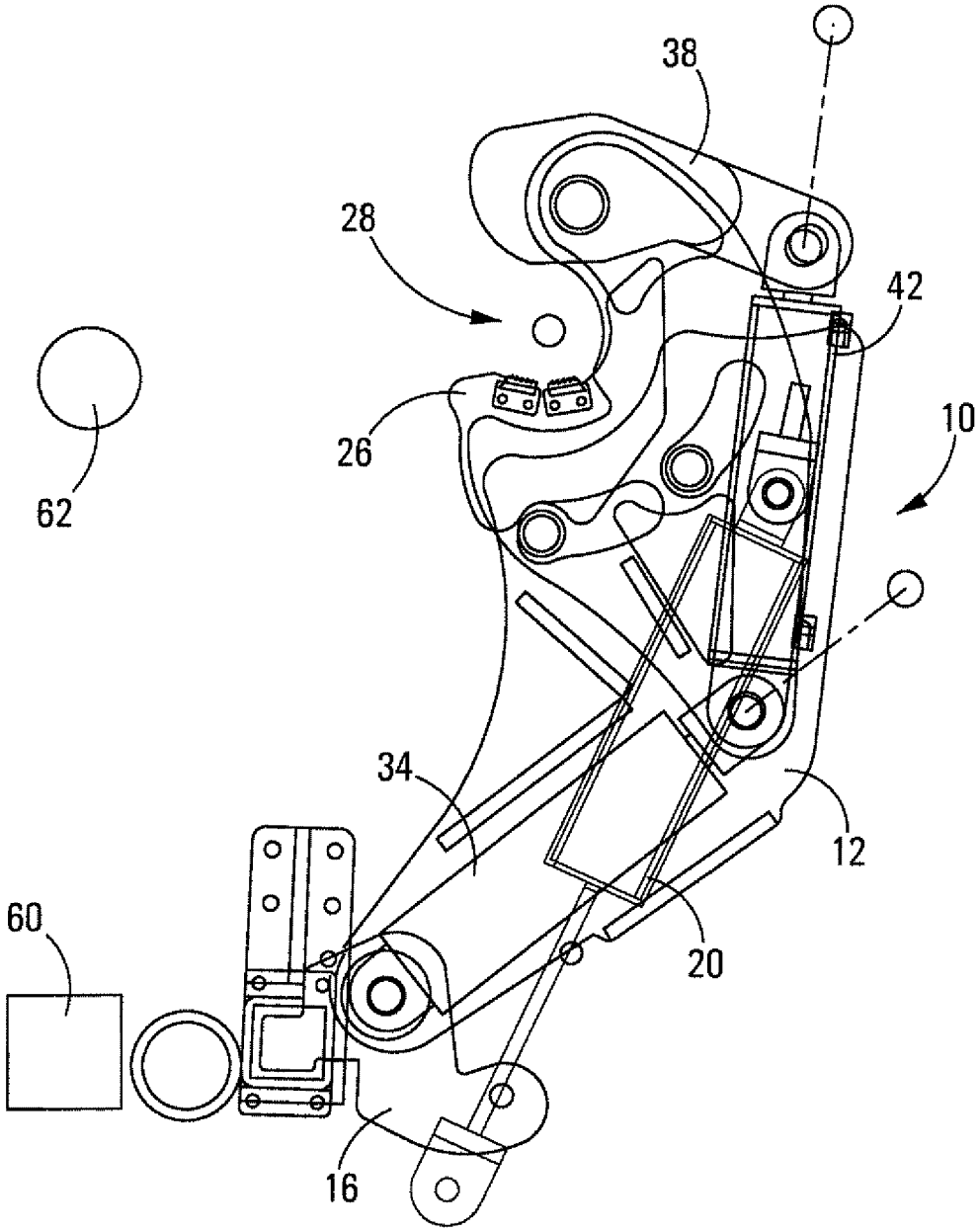

Following loosening of the drill rod segment 62 and, as shown in FIG. 13 of the drawings, by the operation of the piston/cylinder mechanism 42, the lever arm 38 is displaced to permit the release of the drill rod segment 62 and by the following operation of the piston/cylinder mechanism 34, the position of the gripping member 26 with respect to the carrier member 12 can be returned to the position as shown in FIG. 10 of the drawings. Thereafter, and as shown in FIG. 15 of the drawings, by the operation of the piston/cylinder mechanism 20, the drill rod wrench is displaced back into its configuration as shown in FIG. 8 of the drawings, during which a following segment of a hole can be drilled. The process is again repeated for the insertion of each further drill rod segment in line with the drill rod. As explained above, the same operation will be performed in order to remove drill rod segments from a drill rod during the withdrawal of the drill rod from a hole having being drilled.

Figure 16:
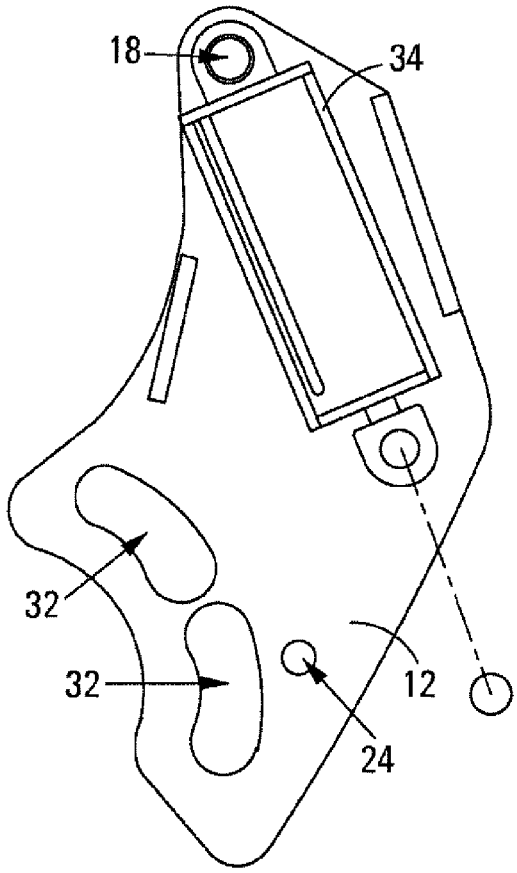
FIG. 16 shows an exploded plan view of a second embodiment of a drill rod wrench for use with drilling apparatus, in accordance with the invention.
Figure 16:
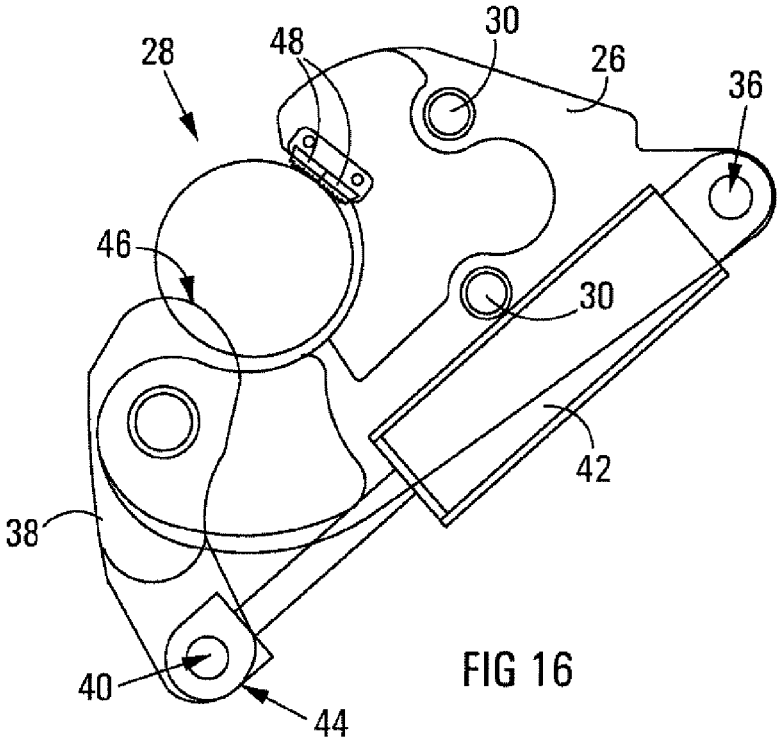
Figure 17:
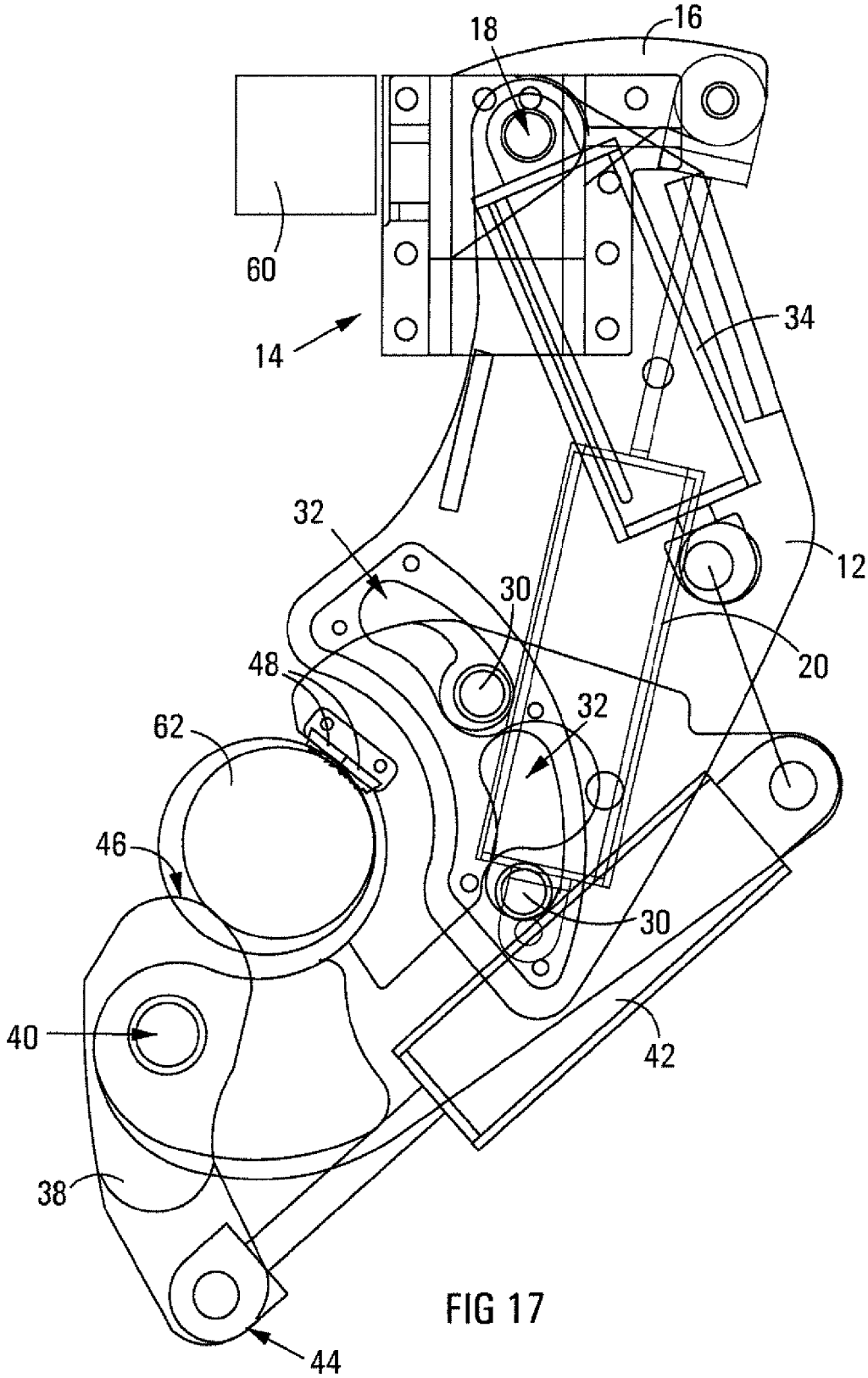
FIG. 17 shows in plan view the drill rod wrench of FIG. 16, in its assembled configuration mounted on the support structure of a drilling apparatus, in a first operative configuration thereof.
Figure 18:
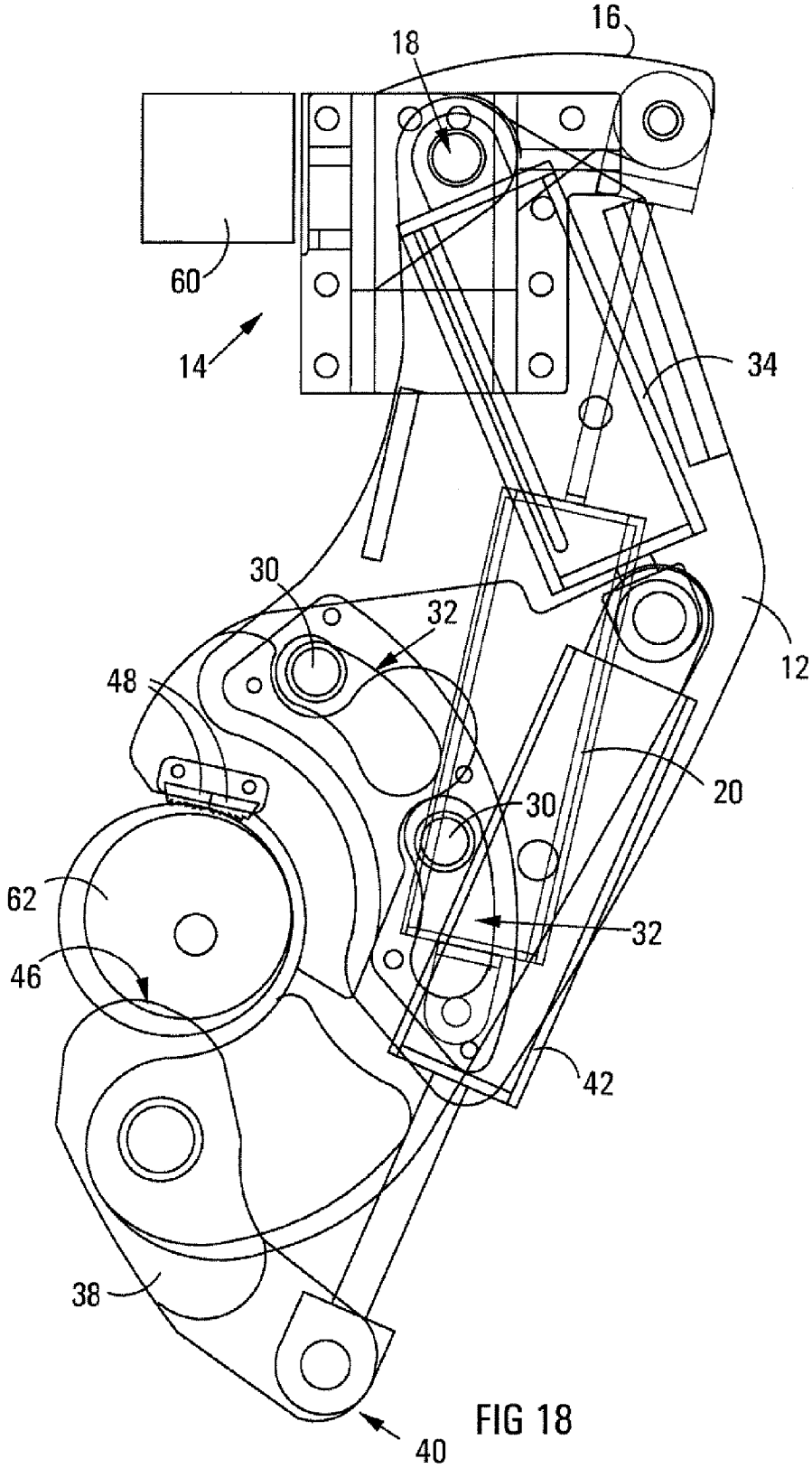
FIG. 18 shows in plan view the drill rod wrench of FIG. 17, in a second operative configuration thereof.

Referring now to FIGS. 16 to 18 of the drawings, a second embodiment of a drill rod wrench for use with drilling apparatus, in accordance with the invention, is designated generally by the reference numeral 80. The construction of the drill rod wrench 80 is essentially equivalent to that of the drill rod wrench 10 and like parts of the drill rod wrench 80 is thus designated by the same reference numerals as before.

As is clearly apparent from FIGS. 17 and 18 of the drawings, the drill rod wrench 80 is particularly configured to be mounted on a support post of the support structure of a drilling apparatus that is disposed "on the opposite side of the drill rod of the apparatus", thus requiring the rotational displacement of the gripping member of the drill rod wrench to be suitably adapted for loosening of a drill rod segment. The operation of the drill rod wrench 80 and particularly the rotational displacement of the gripping member thereof for loosening a drill rod segment is clearly illustrated, the gripping member again being rotated in the required anti-clockwise direction for loosening purposes. For the remainder the operation of the drill rod wrench 80 is essentially the same as that of the drill rod wrench 10.

The drill rod wrenches 10 and 80 are configured particularly to operate within predetermined space restrictions as determined by the configuration of the support structure of the drilling apparatus with which these wrenches are to be used, the exact construction of these wrenches being greatly variable while still incorporating the general principles associated with their construction, which permit their operation within the space restrictions referred to.

Whereas drill rod wrenches of the general type ordinarily rely only upon the wedging action of a lever arm on a drill rod segment for urging it into engagement with gripping elements as herein envisaged, in relation to the drill rod wrenches 10, 80, an initial "direct" gripping force is applied by the piston/cylinder mechanism 42 of these wrenches which act substantially directly on the drill rod segment to be gripped, the gripping force thus being proportional directly to the force imparted on the lever arm by the piston/cylinder mechanism 42. Any additional required gripping force by a wedging action of the convex wedge face defined by the lever arm only is provided for where additional gripping force is required. This particularly facilitates the use of the drill rod wrenches as described within the space restrictions referred to.

The invention claimed is:

1. A drill rod wrench for use on a drilling apparatus for loosening a drill rod segment of a drill rod having a diameter falling within a predetermined diameter range, with respect to an adjacent drill rod segment of the drill rod, which includes, in its operative configuration with respect to a drilling apparatus having a support structure supporting the apparatus in a location where drilling is required, a carrier member that is pivotally supported on the support structure of the drilling apparatus in a configuration in which the wrench is displaceable between an inoperative stowed-away configuration when drilling is permitted and an operative configuration in which the wrench is operable for loosening a drill rod segment;

a gripping member that defines an open mouth formation within which a drill rod segment to be gripped for loosening is positionable, the gripping member being displaceably located on the carrier member for rotational displacement about a longitudinal axis of a drill rod segment operatively positioned within the mouth formation of the gripping member, the gripping member having gripping elements located in the mouth formation for gripping a side of the drill rod segment;

a lever arm pivotally located on the gripping member for pivotal displacement relative to the gripping member about a lever pivot axis, the lever arm defining a convex wedge face that, by pivotal displacement of the lever arm with respect to the gripping member and with a drill rod segment operatively positioned within the mouth formation of the gripping member, acts on the drill rod segment for urging the drill rod segment into gripping engagement with the gripping elements, the convex wedge face when gripping the drill rod segment being located substantially diametrically opposite the gripping elements when gripping the drill rod segment and that, by rotational displacement of the gripping member about a longitudinal axis of the drill rod segment so gripped, performs a wedging action on the drill rod segment until the drill rod segment loosens due to such rotation, for further urging the drill rod segment into gripping engagement with the gripping elements of the gripping member; and displacement mechanisms providing for displacement of the gripping member and the lever arm for gripping and loosening of the drill rod segment with respect to an adjacent drill rod segment.

2. The drill rod wrench as claimed in claim 1, which includes a mounting structure on which the carrier member is pivotally located, the mounting structure being configured for mounting the wrench on the support structure of the drilling apparatus with which the wrench is to be associated and thereby to provide for the required pivotal support of the carrier member with respect to the support structure.

3. The drill rod wrench as claimed in claim 1, wherein the gripping member of the drill rod wrench comprises a plate-like member, the gripping member, for its location with respect to the carrier member, defining a pair of arcuate slots within which locating pins projecting from the carrier member are locatable to provide for the location of the gripping member with respect to the carrier member in the required configuration in which the gripping member is rotationally displaceable about the longitudinal axis of a drill rod segment operatively located within the mouth formation defined thereby, in use, of the drill rod wrench.

4. The drill rod wrench as claimed in claim 3, wherein the open end of the open mouth formation defined by the gripping member of the drill rod wrench is defined by two spaced apart end formations of the gripping member, the lever pivot axis determining the pivotal location of the lever arm on the gripping member, being located near one end formation in a location where, through pivotal displacement of the lever arm with respect to the gripping member, the convex wedge face will effectively push a drill rod segment located within the open mouth formation towards and into gripping engagement with the gripping elements located in the open mouth formation of the gripping member, particularly in substantially diametrically opposite locations with respect to the drill rod segment to the location where the convex wedge face acts on the drill rod segment when pivotally displaced with respect to the gripping member.

5. The drill rod wrench as claimed in claim 1, wherein the displacement mechanisms include:

a) a first piston/cylinder mechanism operatively connected between the support structure of the drilling apparatus and the carrier member and that is hydraulically-operable for displacing the carrier member between its inoperative and operative configurations;

b) a second piston/cylinder mechanism operatively connected between the carrier member and the lever arm to provide for pivotal displacement of the lever arm thereby to urge the convex wedge face of the lever arm against the drill rod segment positioned in the open mouth formation of the gripping member with sufficient force to grip the drill rod segment between the convex wedge formation of the lever arm and the gripping elements of the gripping member; and c) a third piston/cylinder mechanism operatively connected between the carrier member and the gripping member for rotational displacement of the gripping member about the longitudinal axis of the drill rod segment when gripped by the gripping elements and the lever arm, to provide for loosening of the drill rod segment with respect to an adjacent drill rod segment, the gripping force induced by the lever arm increasing as the wedging action of the convex wedge formation continues, until loosening of the drill rod segment occurs.

6. The drill rod wrench as claimed in claim 5, wherein a point of attachment of the third piston/cylinder member to the gripping member coincides with a point of attachment of the second piston/cylinder mechanism to the gripping member.

7. The drill rod wrench as claimed in claim 6, wherein the capacity of the third piston/cylinder mechanism is such that a sufficient rotational force can be applied to a drill rod segment gripped within the open mouth formation defined by the gripping member for loosening thereof, the relationship between the second and third piston/cylinder mechanisms being such that where an increase in the hydraulic pressure applied by the third piston/cylinder mechanism on the gripping member is required for loosening a drill rod segment the increased pressure is effectively transmitted also to the second piston/cylinder mechanism, for further displacing the lever arm and thereby increasing the wedging action on the drill rod segment for enhancing the gripping engagement of the drill rod segment.

* * * * *